US007228810B2

(12) United States Patent
Brown

(10) Patent No.: US 7,228,810 B2
(45) Date of Patent: Jun. 12, 2007

(54) POWERBOAT WITH DISAPPEARING TUNNEL

(76) Inventor: Ralph Brown, 13412 Barlington St., Spring Hill, FL (US) 34609

( * ) Notice: Subject to any disclaimer, the term of this patent is extended or adjusted under 35 U.S.C. 154(b) by 0 days.

(21) Appl. No.: 11/304,355

(22) Filed: Dec. 15, 2005

(65) Prior Publication Data

US 2006/0090684 A1 May 4, 2006

Related U.S. Application Data

(63) Continuation-in-part of application No. 10/889,638, filed on Jul. 12, 2004, now abandoned.

(60) Provisional application No. 60/567,966, filed on May 4, 2004.

(51) Int. Cl.
*B63B 1/32* (2006.01)

(52) U.S. Cl. ..... 114/288; 114/285; 248/642; 440/61 R; 440/69

(58) Field of Classification Search ..... 114/271, 114/284, 285, 288, 289; 440/61 R, 68, 69, 440/70
See application file for complete search history.

(56) References Cited

U.S. PATENT DOCUMENTS 3,990,660 A * 11/1976 Pipoz ..... 248/642
4,713,028 A * 12/1987 Duff ..... 440/61 R
4,757,971 A * 7/1988 Mapes ..... 248/642
4,836,124 A * 6/1989 Haasl ..... 114/285
4,842,559 A * 6/1989 Litjens et al. ..... 440/61 R
6,544,081 B1 * 4/2003 Paulo ..... 440/69

* cited by examiner

*Primary Examiner*—Lars A. Olson
(74) *Attorney, Agent, or Firm*—Allen, Dyer, Doppelt Milbrath & Gilchrist, P.A.

(57) ABSTRACT

A shallow draft boat has a hull that protects a propulsion propeller within a tunnel that passes only partially through the hull from stern to bow. The hull has a mechanism, such as a flap for selectively permitting or blocking water flow access to the tunnel from under the boat. The boat also has a lift mechanism preferably in the shape or adjustable parallelogram for selectively positioning a propeller of a propulsion unit substantially directly behind the tunnel or below the tunnel. The boat can operate in two modes. In one, water access to the tunnel is permitted and the propeller is positioned above the bottom of the hull and behind the tunnel. In the other, water access to the tunnel is blocked and the propeller is positioned below the bottom of the hull. This construction permits selective operation in a shallow draft mode, in a normal draft mode or in between. In the shallow draft mode, the boat prevents propulsion unit malfunction by keeping obstacles, such as debris, crab pots and mammals such as manatees from contact with the propeller.

7 Claims, 8 Drawing Sheets

POWERBOAT WITH DISAPPEARING TUNNEL

CROSS REFERENCE TO RELATED APPLICATIONS

This application is a continuation in part of U.S. patent application Ser. No. 10/889,638, filed Jul. 12, 2004, now abandoned entitled Powerboat with Disappearing Tunnel by inventor Ralph Brown, which is hereby incorporated by reference in its entirety.

This application also incorporates by reference in its entirety and claims priority to U.S. Provisional Application 60/567,966, filed May 4, 2004, entitled Disappearing Tunnel by inventor Ralph Brown.

BACKGROUND OF THE INVENTION

1. Field of the Invention

The invention is directed to a powerboat configuration, and, more particularly, to a powerboat hull with a disappearing tunnel.

2. Description of Related Art

A wide variety of boat constructions are well known in the art. For example, catamaran and trimaran sailboats are well known. Similarly, a significant number of powerboat constructions are well known in the art.

A number of problems exist with respect to powerboats of the prior art. First, they often experience difficulty when running in very shallow water. For example, the propeller, which drives the boat, may encounter the bottom of the waterway and bend the propeller or sheer a pin connecting the propeller to the drive shaft.

Another problem comes from obstacles such as crab pots. The cable that connects the floater with the crab pot can become entangled in the propeller causing the engine to stop and causing the boat operator great difficulty freeing the propeller from the cable.

A similar problem comes from encountering floating debris on the surface of the water. Often, debris floats in such a way that it is not easily visible from the boat. When a powerboat passes over such debris, such as a floating log, the debris may impact the propeller and bend it, or sheer the drive pin, or damage the gear mechanisms.

Serious problems exist in certain waters caused by the presence of large, slow moving mammals such as manatees. The survival of the manatees is and has been threatened by increased boating traffic. The manatees are often found near the surface and cannot move quickly enough to avoid powerboats, resulting in propeller cuts and other injuries to the mammals.

BRIEF SUMMARY OF THE INVENTION

The invention is directed to a powerboat configuration, which overcomes the problems of the prior art. More particularly, the techniques of the invention provide for a tunnel portion, which can be utilized, in one position, to allow a propeller and drive shaft of a boat propulsion system to be protected from obstacles, debris and large mammals, which is particularly suitable for use in shallow water. In the other position, the flap closes the tunnel so that the tunnel is not active and concurrently, the positioning of the propulsion mechanism is changed to allow the propulsion unit to drop below the bottom of the hull. In this configuration, the propulsion unit is not as protected, but considerably less drag is encountered.

BRIEF DESCRIPTION OF THE DRAWINGS

The invention is explained more in detail in conjunction with the following drawings, in which.

DETAILED DESCRIPTION OF THE INVENTION

Figure 1:
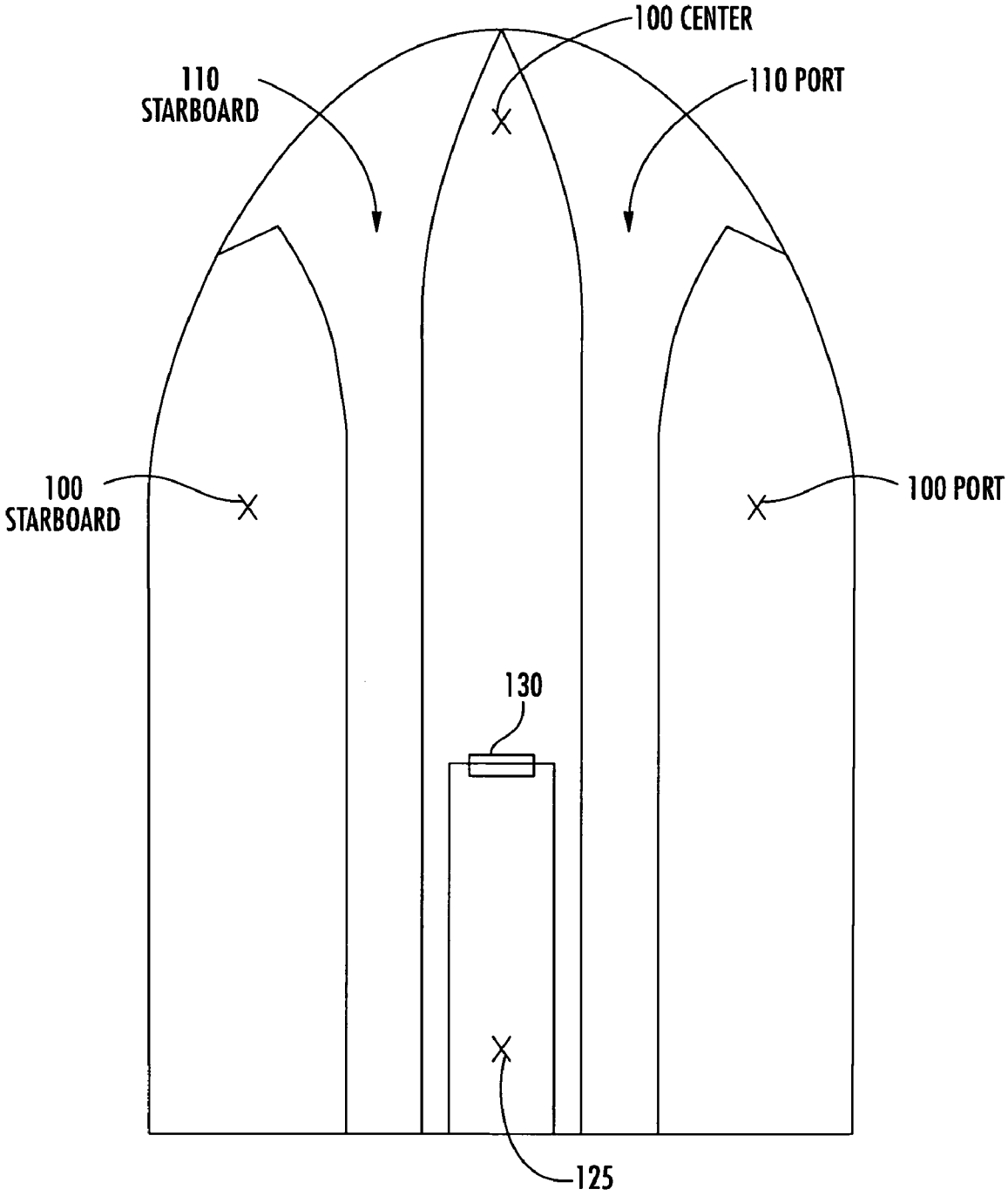
FIG. 1 is a bottom view of the hull of a boat in accordance with one aspect on the invention.

FIG. 1 is a bottom view of a hull of a boat in accordance with one aspect of the invention. In this view, one can see a moveable flap 125 that can be rotated about the axis of a hinge 130 to move from a position that is substantially flat with the bottom of the boat (i.e. one in which the tunnel underneath the flap is substantially not visible and is not functionally usable) to a second position, as described more in conjunction with FIGS. 4A and 4B.

The preferred hull configuration for use with the disappearing tunnel in accordance with the invention is the hull configuration described in U.S. patent application Ser. No. 10/889,624, to inventor Ralph Brown filed concurrently with the parent application. The contents of application Ser. No. 10/889,624, are hereby incorporated herein by reference in its entirety. Alternative preferred hulls are a V-bottom hull and a flat bottom hull.

FIG. 1 is a bottom view of the hull of a boat in accordance with one aspect of the invention. Items 100-port, 100-starboard and 100-center function analogously to three pontoons that might be found on a trimaran sailboat. Two channels are formed, 110-port and 110-starboard between hull sections 100-port and 100-center and 100-starboard and 100-center. Item 120 is a tunnel that extends only partially through hull section 100 center. Item 125 is an opening through which a drive shaft can pass to turn a propeller that operates within tunnel 120.

Figure 2:
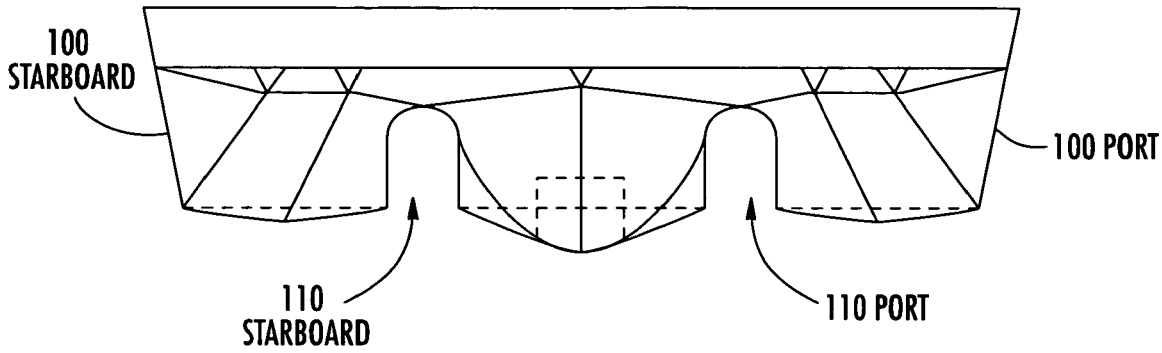
FIG. 2 is a front view of the hull of a boat in accordance with one aspect of the invention.

FIG. 2 is a front view of the hull of a boat in accordance with one aspect of the invention. As shown in FIG. 2, the center portion of the hull 100-center is slightly deeper than the outside portions of the hull, 100-port and 100-starboard. The tunnels formed between the portions of the hull, 110-port and 110-starboard and 100-center are small enough that they fill with water, as more described hereinafter, when the boat is underway.

Figure 3:
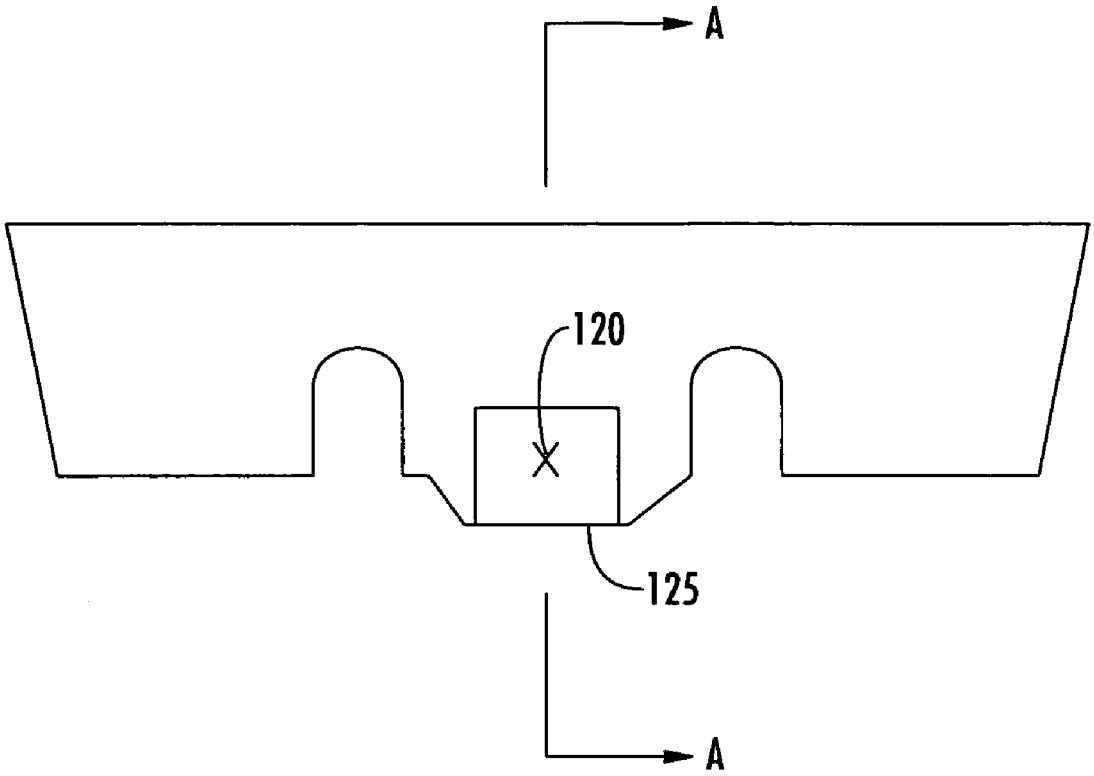
FIG. 3 is a rear view of the hull of a boat in accordance with one aspect of the invention.

FIG. 3 is a rear view of the hull of a boat in accordance with one aspect of the invention. In this view, tunnel 120 is visible as well as the flap 125. As will be seen in conjunction with FIGS. 4A and 4B, the flap 125 moves from a hidden position (shown) to an open position in which the tunnel provides a certain level of protection for the propulsion system.

Figure 4A:
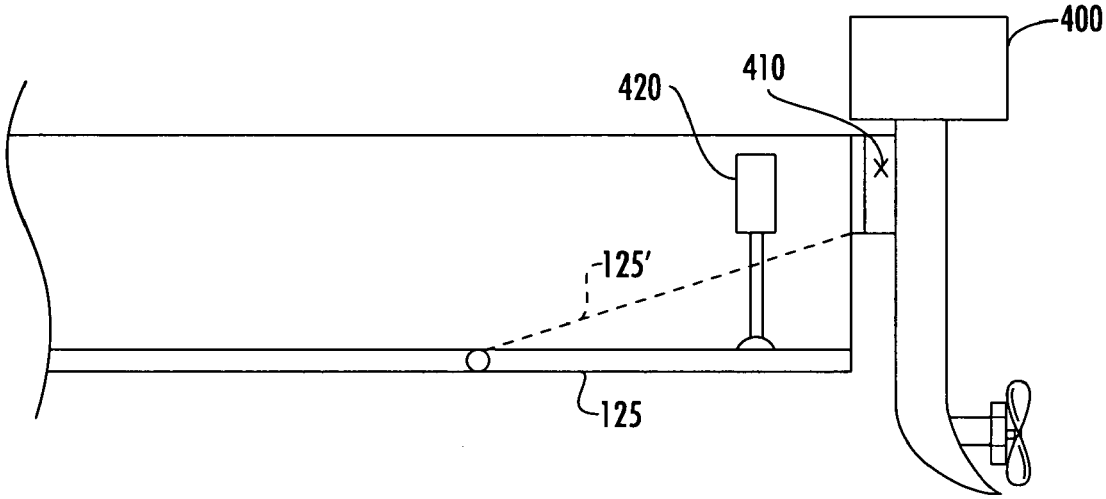
FIG. 4A is a section view of the disappearing tunnel taken from view A—A of FIG. 3, with the propulsion system in a protected position.

FIG. 4A is a sectional view of the tunnel 120 shown along section A—A of FIG. 3. The hinged flap 125 is shown in a hidden position whereby the tunnel 120 is effectively hidden, so that it has substantially no effect on the operation of a boat in this mode. As shown in this figure, the flap can be moved to position 125', shown in dashed lines, to open the tunnel. The propulsion system, such as a traditional outboard engine 400 is mounted to and engine mount 410, which allows the propulsion system to be raised and lowered as desired. The engine mount can comprise a rack and pinion mechanism with the rack mounted on a component holding the propulsion system so that the pinion can drive the propulsion system up and down by virtue of its rotation. This can be hydraulically driven or electrically driven as desired.

The flap 125 can be raised and lowered utilizing one or more by a suitable mechanism such as hydraulic jacks 420 connected to the hull and to the flap so that extension of the hydraulic jack will place the flap in the hidden tunnel position whereas retraction of the jack will place the flap in position 125', by which the tunnel becomes operational.

Figure 4B:
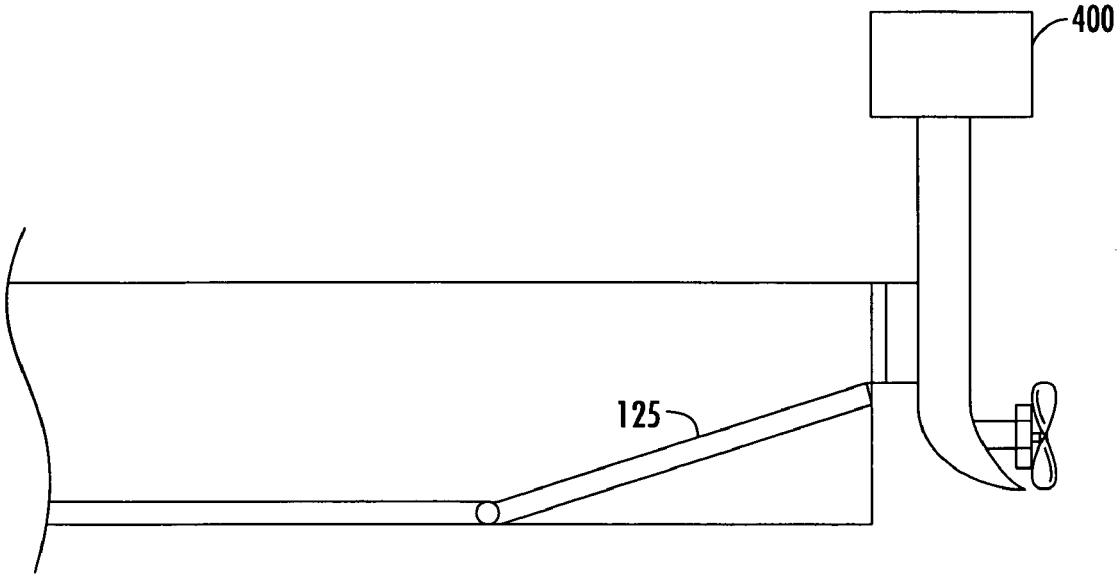
FIG. 4B is a sectional view of the disappearing tunnel taken from view A—A of FIG. 3, with the tunnel obscured and the propulsion system in a running position suitable for deeper water.

FIG. 4B is a sectional view of the hidden tunnel taken from view A—A of FIG. 3, showing the flap in the open and operational position with the propulsion system raised so that it is fed by flow from the open tunnel, rather that extending below the hull of the boat as shown in FIG. 4A.

Figure 5:
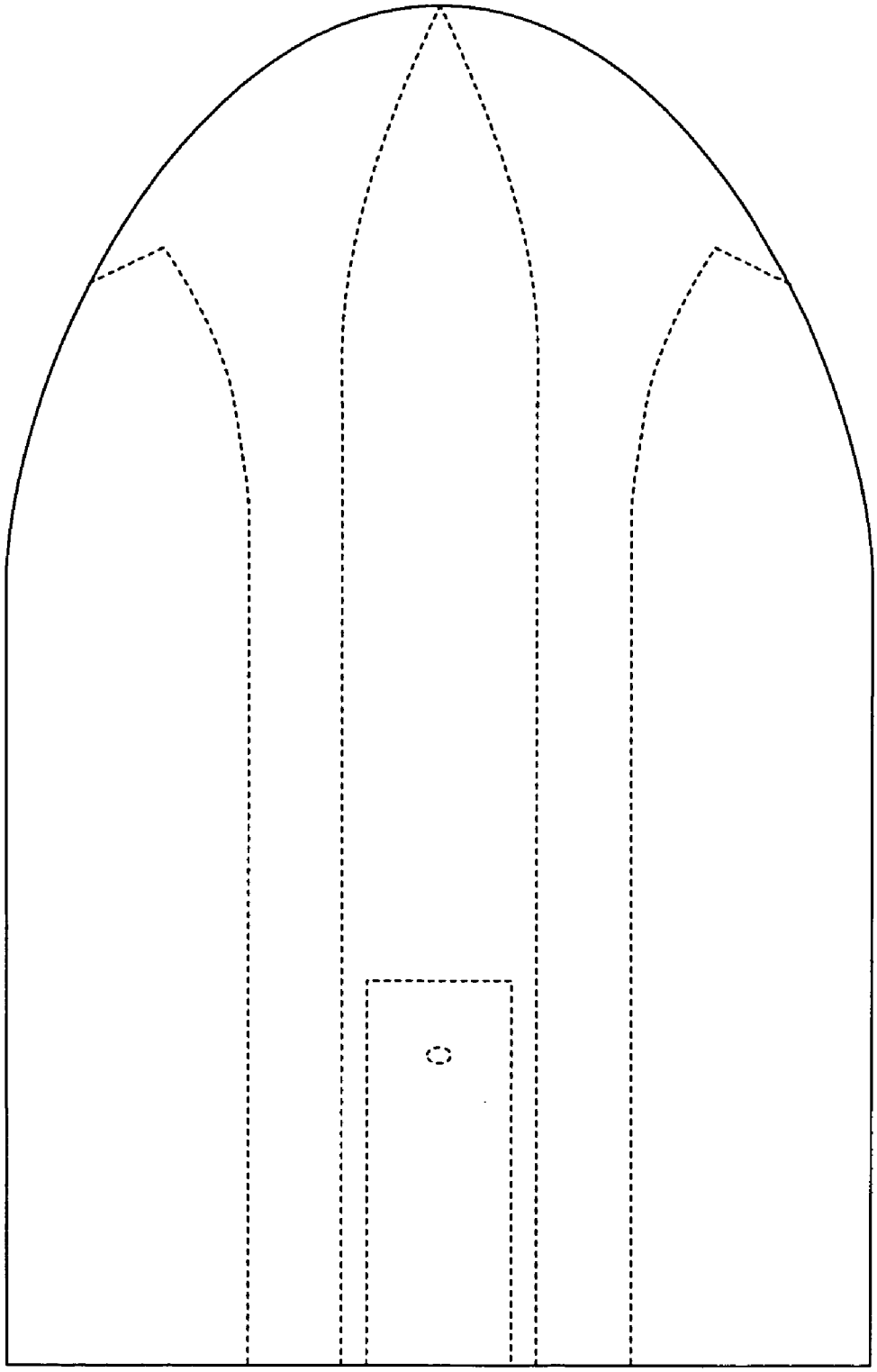
FIG. 5 is a top view of the hull of a boat in accordance with one aspect of the invention.

FIG. 5 is a top view of the hull of a boat in accordance with one aspect of the invention.

Figure 6A:
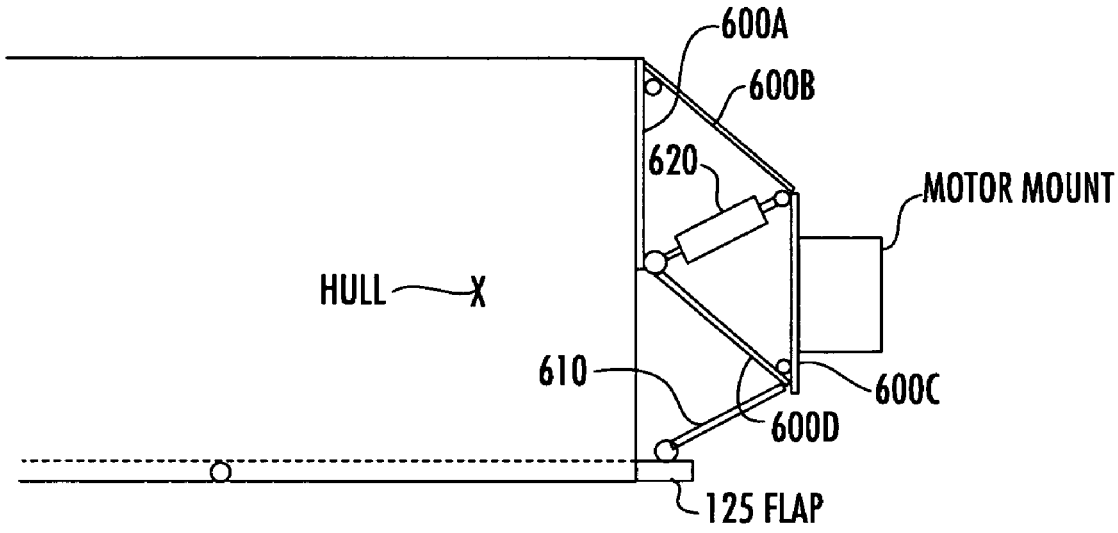
FIG. 6A is a side view of a boat in accordance with one aspect of the invention which shows a preferred mechanism for simultaneously raising and lowering the motor while respectively opening and closing the tunnel. This figure is shown with the tunnel in closed position.

FIG. 6A shows a partial side view of a boat hull with the preferred mounting mechanism in accordance with one aspect of the invention. A mounting bracket comprising plates 600A, 600B, 600C and 600D shown in edge view in FIG. 6A comprise a lifting mechanism. The lift mechanism is powered by actuator 620, the actuator can be electric, pneumatic or hydraulic. In a retracted position, shown in FIG. 6A, the ends of the actuator cylinder are close together, bringing two of the vertices of the lift mechanism close together resulting in the positioning shown. Small circles in the drawing indicate that the connection between plates or between the actuator in the plate are hinged so as to permit changes in the angles between them. Note that a connection 610 exists near the junction of plate 600C and 600D and the flap, in this example, utilized to close off the tunnel. In the figure shown, the tunnel is closed and the motor is located beneath the hull of the boat to permit running at a high speeds in deeper water.

Figure 6B:
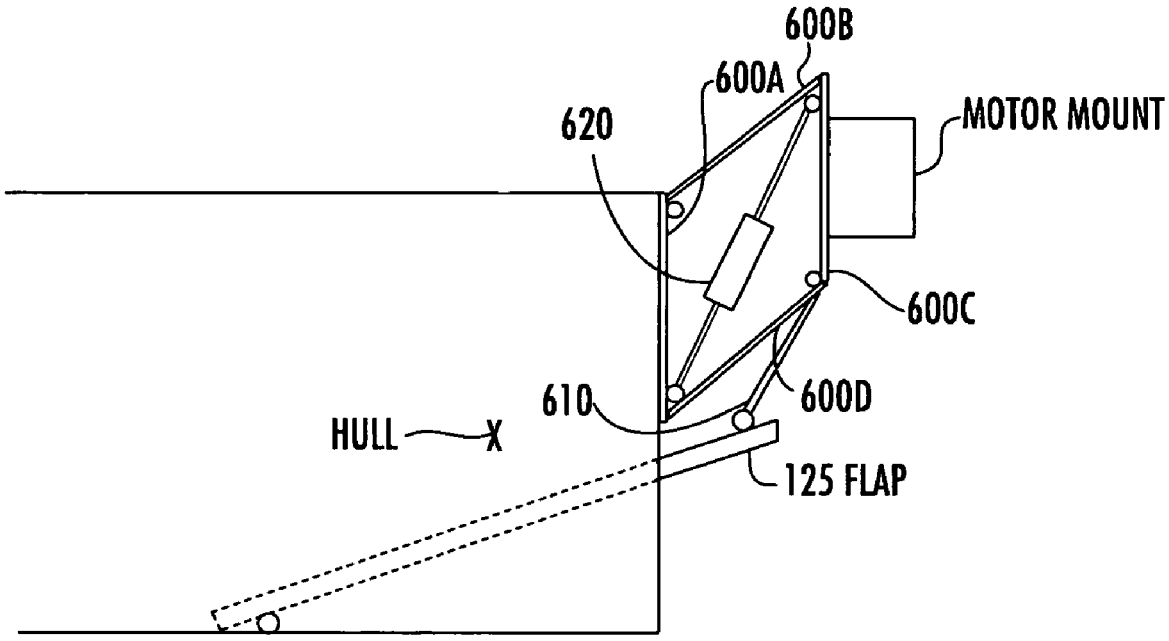
FIG. 6B corresponds to the FIG. 6A with the motor in a raised position with the tunnel open.

FIG. 6B corresponds to FIG. 6A except that the actuator mechanism 620 is extended forcing the vertices to which it is connected further apart and causing the parallelogram shape of the lift mechanism to adapt as shown. This has the impact of simultaneously raising the motor to a point where the propeller is located behind the tunnel and generally above the bottom of the hull of the boat, while simultaneously opening the flap, in this example, which enables the tunnel to provide water flow to the propeller so that cavitation is minimized in shallow water. This achieves many of the benefits of the invention discussed above.

Note that normal vertical lift plates, as opposed to the lift mechanism shown in FIG. 6A and 6B have a limited range of motion. When large motors are utilized such as outboard motors in excess of 115 hp larger propellers are utilized. Vertical jack plates which are commercially available to not have adequate lift to move the large propellers utilized with the larger outboard motors to a height that where the bottom of the propeller is above the bottom of the hull of the boat. The lift mechanism of the invention, provides adequate lift, even for larger engines, so that the propeller is protected from damage from objects or animals beneath the hull. In a preferred embodiment, the Porta-Bracket produced by Porta-Products Corporation can be utilized for part of the lift mechanism described in accordance with the invention.

Traditionally a boat will come with or without a tunnel. The tunnel makes running in shallow water more possible. However, the tunnel increases the drag and reduces the efficiency of the outboard motor.

The disappearing tunnel gives the best of both worlds. When needed the tunnel flap is moved up activating the tunnel. At this time the operator can also raise the motor using a lift plate, allowing the boat to run in extremely shallow water.

When the boat goes into deep water the operator can lower the tunnel flap making the tunnel disappear and allowing the operator to lower to outboard motor with the lift mechanism. This makes the boat operate much more efficiently.

These techniques can be used on a flat bottom boat, a "V" bottom boat, a catamaran, a trimaran, or any other type hull. The tunnel flap can be raised by securing the end closest to the bow with a hinge, and using a hydraulic or electric cylinder to raise it or to lower it. The lift plate for the motor can also use either a hydraulic or electric cylinder.

The techniques described herein can be applied to a variety of different hull shapes in addition to the specific embodiment described herein within the scope of the invention.

The invention described herein is not limited to the specific examples shown, but rather has a broad applicability to boat construction generally.

What is claimed is:

1. A boat, comprising:

a. a hull having a tunnel passing through only a portion of the length from bow to stern; and b. a mechanism for selectively permitting or blocking water flow access to the tunnel from under the boat;

c. a propulsion unit; and d. a lift mechanism substantially in the shape of an adjustable parallelogram driven by an actuator between vertices to position a propeller of the propulsion unit so that it selectively operates substantially directly behind the tunnel or below the tunnel, while at the same time respectively permitting or blocking water flow access to the tunnel.

2. The boat of claim 1 in which the hull and the tunnel protect the propeller from obstacles when water flow access to the tunnel is permitted and the propulsion unit is positioned behind the tunnel.

3. The boat of claim 1 in which the mechanism for selectively permitting or blocking water flow access to the tunnel from under the boat comprises a moveable flap.

4. The boat of claim 3 in which the flap is hinged to permit or block water flow access to the tunnel.

5. The boat of claim 1 in which the position of the lift mechanism can be controlled by an electric, pneumatic, or hydraulic device.

6. A method of designing a boat, comprising the steps of:

a. providing a hull having a tunnel passing through only a portion of the length from bow to stern;

b. providing a mechanism for selectively permitting or blocking water flow access to the tunnel from under the boat;

c. providing a lift mechanism in the shape of an adjustable parallelogram driven by an actuator between vertices to position a propeller of a propulsion unit so that it can selectively operate substantially directly behind the tunnel or below the tunnel, while at the same time respectively permitting or blocking water flow access to the tunnel.

7. A method of reducing a boats draft, comprising:

a. providing a tunnel in the hull extending only part way from stern to bow;

b. providing a mechanism for selectively permitting or blocking water flow access to the tunnel from under the boat; and c. providing a lift mechanism in the shape of an adjustable parallelogram drawn by an actuator between vertices for selectively positioning a propeller of a propulsion unit substantially directly behind the tunnel or below the tunnel, while at the same time respectively permitting or blocking water flow access to the tunnel.

* * * * *